US008123034B2

(12) United States Patent
Apps et al.

(10) Patent No.: US 8,123,034 B2
(45) Date of Patent: Feb. 28, 2012

(54) NESTABLE CRATE FOR CONTAINERS

(75) Inventors: William P. Apps, Alpharetta, GA (US); Robert V. Gruber, Hermosa Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 12/581,457

(22) Filed: Oct. 19, 2009

(65) Prior Publication Data

US 2010/0065462 A1 Mar. 18, 2010

Related U.S. Application Data

(63) Continuation of application No. 10/958,618, filed on Oct. 4, 2004, now Pat. No. 7,604,122, which is a continuation of application No. 09/977,636, filed on Oct. 15, 2001, now Pat. No. 6,892,885.

(51) Int. Cl.
*B65D 21/032* (2006.01)

(52) U.S. Cl. ..... 206/519; 206/518; 206/509

(58) Field of Classification Search ..... 206/509, 206/518, 519, 515, 510
See application file for complete search history.

(56) References Cited

U.S. PATENT DOCUMENTS

| | | | | |
|---|---|---|---|---|
| D152,907 | S | 9/1946 | Richards | |
| 4,773,554 | A | 9/1988 | Warwick | |
| 4,819,822 | A * | 4/1989 | Box | 220/675 |
| 4,899,874 | A | 2/1990 | Apps et al. | |
| 4,928,841 | A | 5/1990 | Arthurs | |
| 4,932,532 | A | 6/1990 | Apps et al. | |
| 4,978,002 | A | 12/1990 | Apps et al. | |
| D318,552 | S | 7/1991 | Apps | |
| D319,129 | S | 8/1991 | Apps et al. | |
| D320,298 | S | 9/1991 | Apps et al. | |
| 5,060,819 | A | 10/1991 | Apps | |
| D325,279 | S | 4/1992 | Apps | |
| D327,357 | S | 6/1992 | Rehrig | |
| D327,972 | S | 7/1992 | Apps et al. | |
| D329,931 | S | 9/1992 | Apps | |
| 5,184,748 | A | 2/1993 | Apps | |
| 5,230,601 | A | 7/1993 | Apps et al. | |
| 5,267,649 | A | 12/1993 | Apps et al. | |
| D343,042 | S | 1/1994 | Apps et al. | |
| 5,285,899 | A | 2/1994 | Apps et al. | |
| 5,305,884 | A | 4/1994 | Apps et al. | |
| 5,316,172 | A | 5/1994 | Apps et al. | |
| 5,320,245 | A | 6/1994 | Apps et al. | |

(Continued)

FOREIGN PATENT DOCUMENTS

| | | | |
|---|---|---|---|
| JP | 52-80993 | A | 7/1977 |

(Continued)

*Primary Examiner* — Stephen Castellano
(74) *Attorney, Agent, or Firm* — Carlson, Gaskey & Olds

(57) ABSTRACT

A nestable crate for bottles includes a floor portion having a floor top surface, a floor bottom surface and a plurality of bottle support areas. A wall structure is connected to the floor portion and forms a containment area therewith. The wall structure has a peripherally extending upper band portion with an interior surface and an exterior surface, and also has a single-walled lower wall construction comprising adjacent column members which extend between the upper band the and floor portion. The wall structure includes sidewalls and end walls, and adjacent column members have curved facing surfaces extending inwardly into the containment area. The inner surface of the upper band portion, one of the plurality of bottle support areas, and the facing surfaces define a plurality of bottle receiving pockets extending around the periphery of the wall structure.

3 Claims, 17 Drawing Sheets

U.S. PATENT DOCUMENTS

| | | | |
|---|---|---|---|
| 5,323,925 | A | 6/1994 | Apps |
| D356,211 | S | 3/1995 | Apps et al. |
| D356,679 | S | 3/1995 | Apps et al. |
| 5,405,042 | A | 4/1995 | Apps et al. |
| 5,421,477 | A | 6/1995 | Hammett |
| D361,431 | S | 8/1995 | Koefelda |
| D361,663 | S | 8/1995 | Kalin |
| 5,445,273 | A | 8/1995 | Apps |
| 5,465,843 | A | 11/1995 | Koefelda |
| 5,487,487 | A | 1/1996 | Hammett |
| 5,495,945 | A | 3/1996 | Apps et al. |
| 5,501,352 | A | 3/1996 | Apps |
| 5,529,176 | A | 6/1996 | Apps et al. |
| D371,239 | S | 7/1996 | Kelly |
| D378,249 | S | 3/1997 | Apps et al. |
| D379,121 | S | 5/1997 | Apps et al. |
| D379,717 | S | 6/1997 | Apps et al. |
| D380,613 | S | 7/1997 | Apps et al. |
| D380,901 | S | 7/1997 | Apps et al. |
| 5,651,461 | A | 7/1997 | Apps et al. |
| 5,660,279 | A | 8/1997 | Apps et al. |
| 5,704,482 | A | 1/1998 | Apps et al. |
| D398,152 | S | 9/1998 | Kelly |
| D400,012 | S | 10/1998 | Apps |
| 5,823,376 | A | 10/1998 | McGrath |
| 5,842,572 | A | 12/1998 | Apps et al. |
| D404,204 | S | 1/1999 | Apps |
| 5,855,277 | A | 1/1999 | Apps et al. |
| 5,913,424 | A | 6/1999 | Kelly et al. |
| 5,918,751 | A | 7/1999 | Kelly |
| 5,979,654 | A | 11/1999 | Apps |
| D417,784 | S | 12/1999 | Umiker |
| 6,006,912 | A | 12/1999 | McGrath |
| D420,220 | S | 2/2000 | Apps et al. |
| 6,047,844 | A | 4/2000 | McGrath |
| 6,073,793 | A | 6/2000 | Apps et al. |
| 6,079,554 | A | 6/2000 | Hammett et al. |
| D441,957 | S | 5/2001 | Kelly |
| D462,522 | S | 9/2002 | Apps et al. |
| D487,634 | S | 3/2004 | Apps et al. |
| 6,749,065 | B1 | 6/2004 | Hammett |
| 6,892,885 | B2 | 5/2005 | Apps et al. |
| 7,322,475 | B2 | 1/2008 | Hassell et al. |

FOREIGN PATENT DOCUMENTS

| | | |
|---|---|---|
| WO | 01/02261 | 1/2001 |

* cited by examiner

NESTABLE CRATE FOR CONTAINERS

CROSS-REFERENCE TO RELATED APPLICATION

This is a continuation application of U.S. Ser. No. 10/958,618, filed on Oct. 4, 2004, now U.S. Pat. No. 7,604,122, issued on Oct. 20, 2009, which is a continuation of U.S. Ser. No. 09/977,636, filed on Oct. 15, 2001, now U.S. Pat. No. 6,892,885, issued on May 17, 2005.

BACKGROUND OF THE INVENTION

1. Field of the Invention

The present invention relates to a nestable crate for transporting and storing containers, and particularly bottles.

2. Background Art

Bottles, particularly those used to contain soft drinks and other beverages, are often transported and stored in crates having a bottom surrounded by four sidewalls. These crates generally are configured to be stacked on top of each other both when empty and when loaded with bottles. These crates are known in the art generally as full-depth and half-depth crates. Half-depth crates are shorter than full-depth crates, thus providing for greater visibility of the crates' contents.

Full-depth and half-depth crates are not designed to nest with one another and do not significantly stack, and thus do not store efficiently when empty. They typically have vertical exterior surfaces from top to bottom, and minimal wall stock, for providing a minimal overall length and width to allow for as much bottle density and as little crate structure as possible, in order to provide for pallet optimization, with little or no pallet overhang. The bottom of these crates extends downwardly and inwardly offset from the sidewalls defining a crate footprint. The stacking feature of such crates is typically limited to this bottom footprint, which is received within the rim of a like container to achieve more stable stack. One design is shown in U.S. Design Pat. No. D 361,663.

These crates are designed to balance many factors, including the need for structure and strength against having a footprint appropriately sized to provide pallet optimization. However, to achieve a significant degree of nesting with such crates, beyond that described above, would require a larger footprint, a more significant sidewall structure and more taper in the walls, and therefore detracts from the aforementioned pallet optimization.

On the other hand a third type of crate, low-depth crates, have generally been designed for bottles having a straight, cylindrical body with tapering tops. Unlike their half-depth and full-depth counterparts, low-depth crates typically have a led construction with tapered sidewalls—thus leading to greater pallet overhang—in order to provide for a nesting height of typically 50% between like crates. Bottles placed in low-depth and half-depth crates extend above the sidewalls of the crates. Thus, when loaded with bottles and in a stacked orientation, containers in such crates must be able to support the weight of other cases stacked on top of them. Once loaded with bottles, crates are typically stacked on top of each other in layers on top of a pallet, which is then lifted and moved about by forklifts. However, many low depth nestable crates may lack the features for maintaining loaded bottles in a substantially vertically upright position to bear the compressive load of crates stacked thereon.

Further, it is common for entire layers of crates to be lifted and moved about by way of an automated product lifting and handling device which can be installed on a conventional forklift and enables the lifting of an entire layer of product from a pallet. Briefly, such devices typically grabs each side of a layer of crates and use compressive loads to keep the layer intact, transferring forces from the sidewalls of the crate to the bottles therein, to the sidewalls of an adjacent crate, and so on. Unfortunately, some crates may not provide sufficient surface area or vertical sidewall construction, which would hinder or prevent the use of the automatic handling machinery. The often tapered sidewalls of a low-depth crate is just one example.

Thus, there is a need for an improved crate for storing and transporting containers, and particularly beverage containers. Such crate should be nestable to provide for more efficient storing and handling of the crates when emptied. Further, such crates should maintain bottles stored therein in a generally upright position. The crates should also be able to nest with various types of crates, including similar crates and non-similar half-depth and full-depth crates. Moreover, when similar crates are in a layered orientation, such crates should be capable of being lifted by automated lifting machinery.

SUMMARY OF THE INVENTION

Accordingly, it is an object according to the present invention to provide a low-depth crate, which is nestable with other similar crates when empty in order to provide more efficient storage.

It is another object according to the present invention to provide a low-depth crate, which is nestable within empty crates of similar construction and half-depth crates.

Another object according to the present invention is to provide a lowdepth nestable crate, which maintains containers, stored therein in a substantially upright position.

Yet another object according to the present invention is to provide a lowdepth nestable crate which, when oriented in a layer with similar crates, is able to be lifted by automated lifting machinery.

In accordance with the objects and teachings of the present invention, provided is a nestable crate for bottles having a floor portion with a floor top surface and a floor bottom surface. The floor top surface has a plurality of bottle support areas for supporting bottles. Also included is a low-depth wall structure connected to the floor portion and forming a containment area therewith. The wall structure has a peripherally extending upper band portion having an interior surface and an exterior surface. The wall structure further has a single-walled lower wall construction comprising adjacent column members which extend between the upper band the and floor portion. The wall structure includes sidewalls and end walls. A plurality of bottle receiving pockets extends around the periphery of the wall structure for maintaining bottles in a vertically upright manner. Each pocket is defined by the inner surface of the upper band portion, one of the plurality of bottle support areas, and a pair of facing surfaces disposed on adjacent column members extending inwardly from the upper band portion into the containment area to secure bottles therein in an upright manner. The pair of facing surfaces preferably have a concave shape. Further the upper band member has an inner surface with a plurality of nesting members aligned with corresponding column members, such that an outer surface of the column members are configured to receive the nesting members of a like crate when in a nesting orientation. The nesting members have a double-walled construction. The band also includes a bottle contact surface that has a curvature corresponding to the pair of facing surfaces.

In another embodiment, the band includes a plurality of single-walled upright concave inner surfaces which are arranged in an alternating manner with the columns and are positioned to correspond to the bottles. The inner surface of the upper band portion includes a bottle contact surface adjacent the bottle receiving pocket. The upper band portion and facing surfaces define a window therebetween which is disposed below the top band.

Also provided is a low-depth nestable crate for holding bottles which has a low-depth wall structure having sidewalls and end walls, and a floor member having a floor top surface and a floor bottom surface. It also has a band extending around the periphery of the crate and spaced above the floor member for preventing the bottles from tipping. The band has spaced-apart interior nesting projections. Also included is a plurality of columns which are disposed along the sidewalls and end walls for connecting the band member and the floor member. The columns are spaced apart and have a nesting window disposed therebetween. The columns have an interior surface and an exterior surface and project inwardly from the band such that an adjacent pair of columns defines a bottle receiving area for containing one of the bottles therein. The interior surface of each column has a pair of opposed members meeting at a centrally disposed surface. The exterior surface of the column has a recess to matingly receive corresponding interior nesting projections from a similar crate nested therebelow. The interior surfaces of the columns preferably have a cylindrically concave surface extending from a lower column edge to an upper column edge. The band may also include a plurality of upright concave inner surfaces arranged in an alternating manner with the columns and positioned to correspond to the bottles. The cylindrically concave surface and its adjacent upright concave inner surface have a similar curvature radius.

Any of the crates disclosed herein are preferably arranged to nest within a lower bottle crate having a generally vertical wall structure having an upper surface, outer surface and inner surface, as well as a floor attached to the wall structure and defining a compartment therewith. When nested, the exterior surface of the upper wall member of the upper bottle crate disclosed herein is generally co-planar with the outer surface of the wall structure of the lower bottle crate.

The above objects and other objects, features, and advantages of the present invention are readily apparent from the following detailed description of the best modes for carrying out the invention when taken in connection with the accompanying drawings.

DETAILED DESCRIPTION OF THE PREFERRED EMBODIMENT(S)

Figure 1:
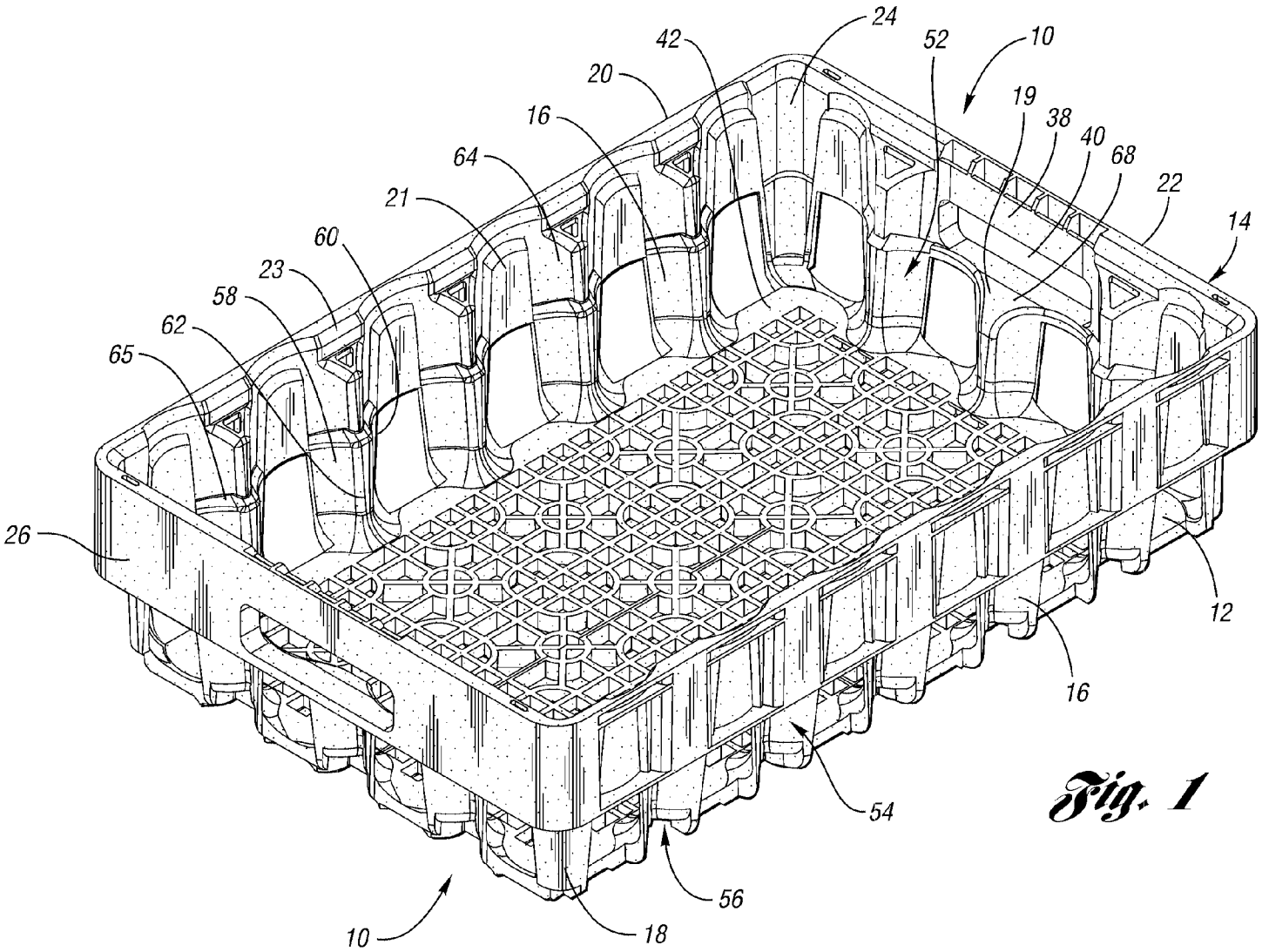
FIG. 1 is a perspective view of a first embodiment of a nestable bottle crate according to the present invention.

In accordance with the present invention, provided in FIGS. 1-7 is a first embodiment of a nestable bottle crate 10 which is suitable for holding containers 5 (shown as bottles in FIGS. 19-20) therein. Crate 10 is preferably formed from a plastic material, such as high density polyethylene (HDPE), by an injection molding or other suitable plastic molding process. Crate 10 is also preferably formed as a unitary member with all components integrally connected. Containers 5 may be used for beverages and have a generally cylindrical shape. Referring to FIG. 1, crate 10 includes a floor member 12, and also includes a wall structure that has a top band 14 (or upper wall member) and a plurality of columns 16 (or lower wall member) extending around the periphery of the floor member 12 for connecting floor member 12 to top band 14. Columns 16 are arranged along the sides of crate 10. Crate 10 also includes corner column members 18 at each of the corners of crate 10. The wall structure includes sidewalls 20 and end walls 22. Crate 10 may have a rectangular or square shape. A compartment is defined by the wall structure and the floor member.

Figure 2:
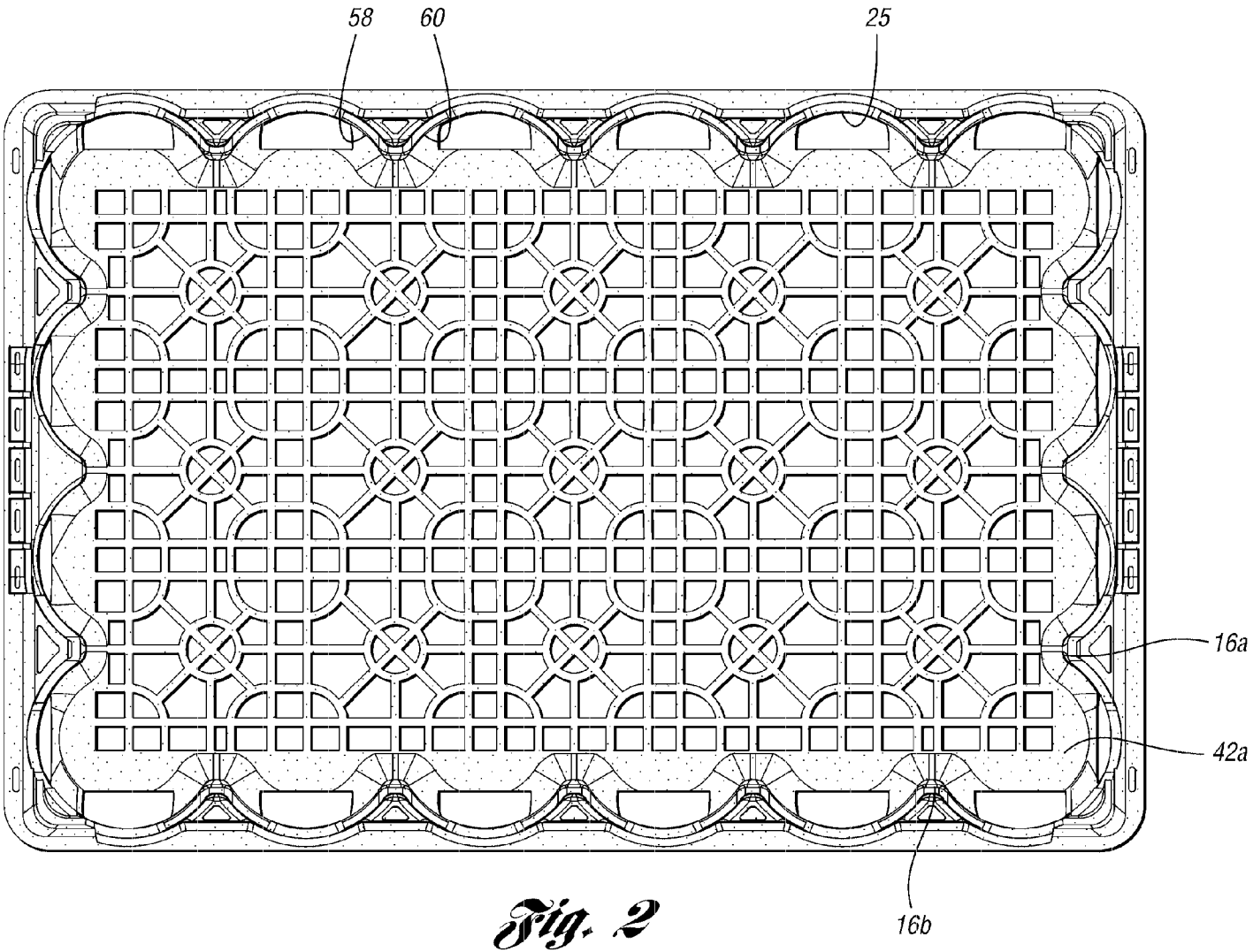
FIG. 2 is a top plan view of the crate of FIG. 1.
Figure 3:
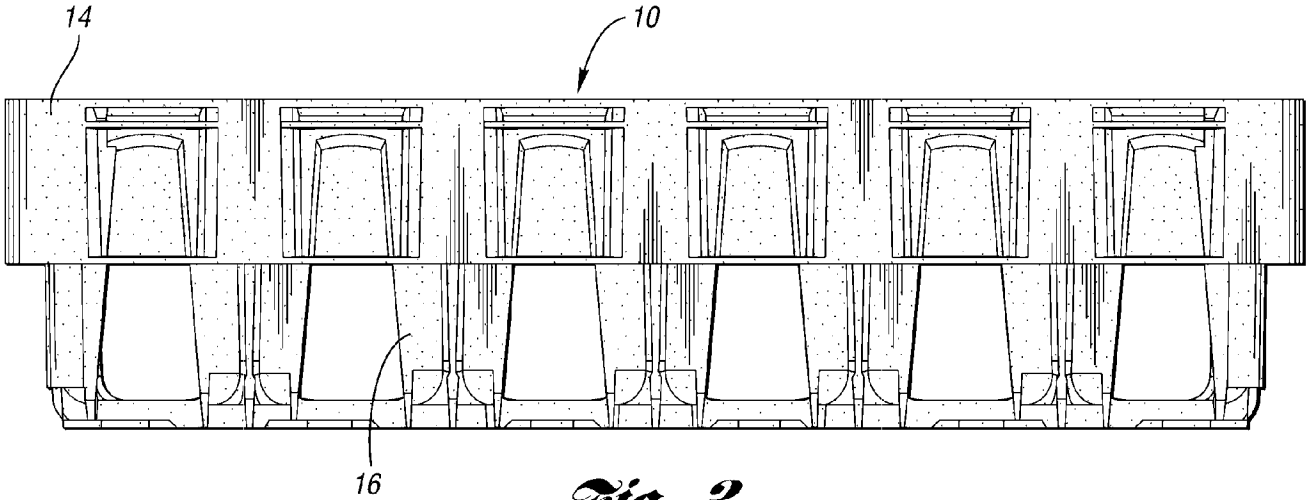
FIG. 3 is a front side elevational view of the crate of FIG. 1, the rear side elevational view being a mirror image thereof.
Figure 4:
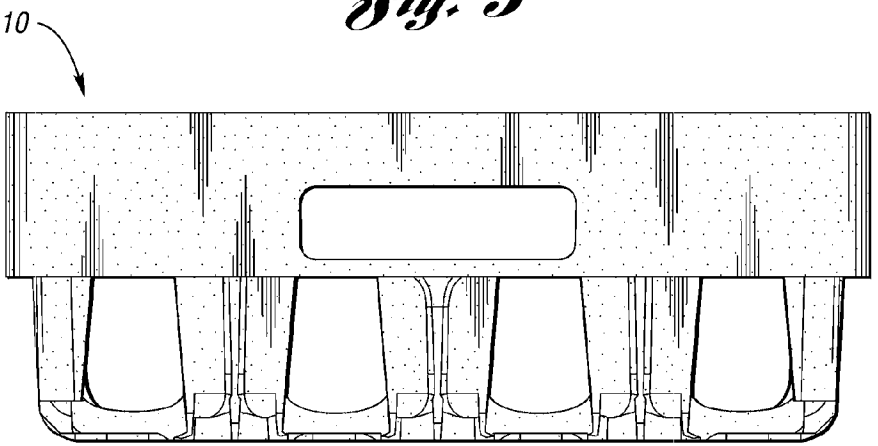
FIG. 4 is a left end elevational view of the crate of FIG. 1, the right end elevational view being a minor image thereof.

As shown in FIG. 1, top band 14 extends around the periphery of crate 10 and includes a sidewall 20 having a plurality of bottle contact areas 21 which are illustrated as single-walled, while having a double-walled construction 23 between adjacent bottle contact areas 21. In addition, end walls 22 are illustrated as having a double-walled construction, but may also be formed with single wall portions. Top band 14 has an interior surface 24 and an exterior surface 26. Top band 14 is oriented generally perpendicular to floor member 12 and is spaced above floor member 12 a sufficient height to prevent bottles stored therein from tipping. As illustrated in a later embodiment of FIGS. 19-20, bottles 5 stored within crate 10 along the side and end walls 20,22, are disposed adjacent their corresponding bottle contact surfaces. FIG. 2 shows that interior surface 24 has a curved or cylindrically shaped bottle contact surface 21, but it is contemplated that it may also be a flat surface.

Top band 14 provides the desired strength and rigidity to crate 10, while allowing for a relatively lighter weight crate by its partial single-walled construction. Exterior surface 26 of top band is generally vertically disposed.

A handle portion 38 is also included in the band member 14 of end walls 22 by which a user may grasp crate 10. An opening 40 is disposed below handle member 38 through which a user's fingers may extend for handling crate 10 in association with handle 40. The central end wall columns define an inwardly extending nesting ledge 68, which provides an additional stop during nesting.

Figure 9:
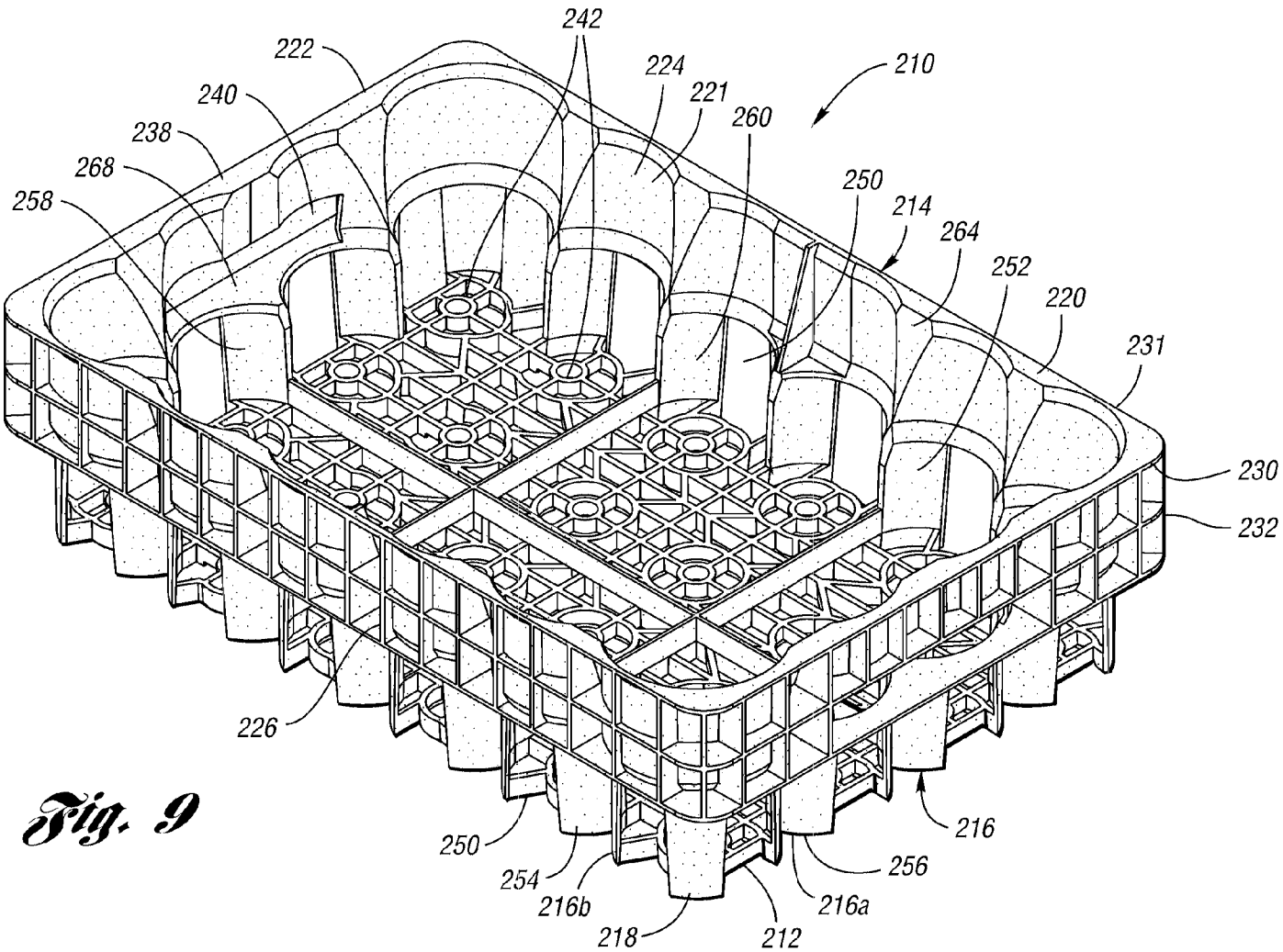
FIG. 9 is a perspective view of a third embodiment of a nestable bottle crate according to the present invention.
Figure 10:
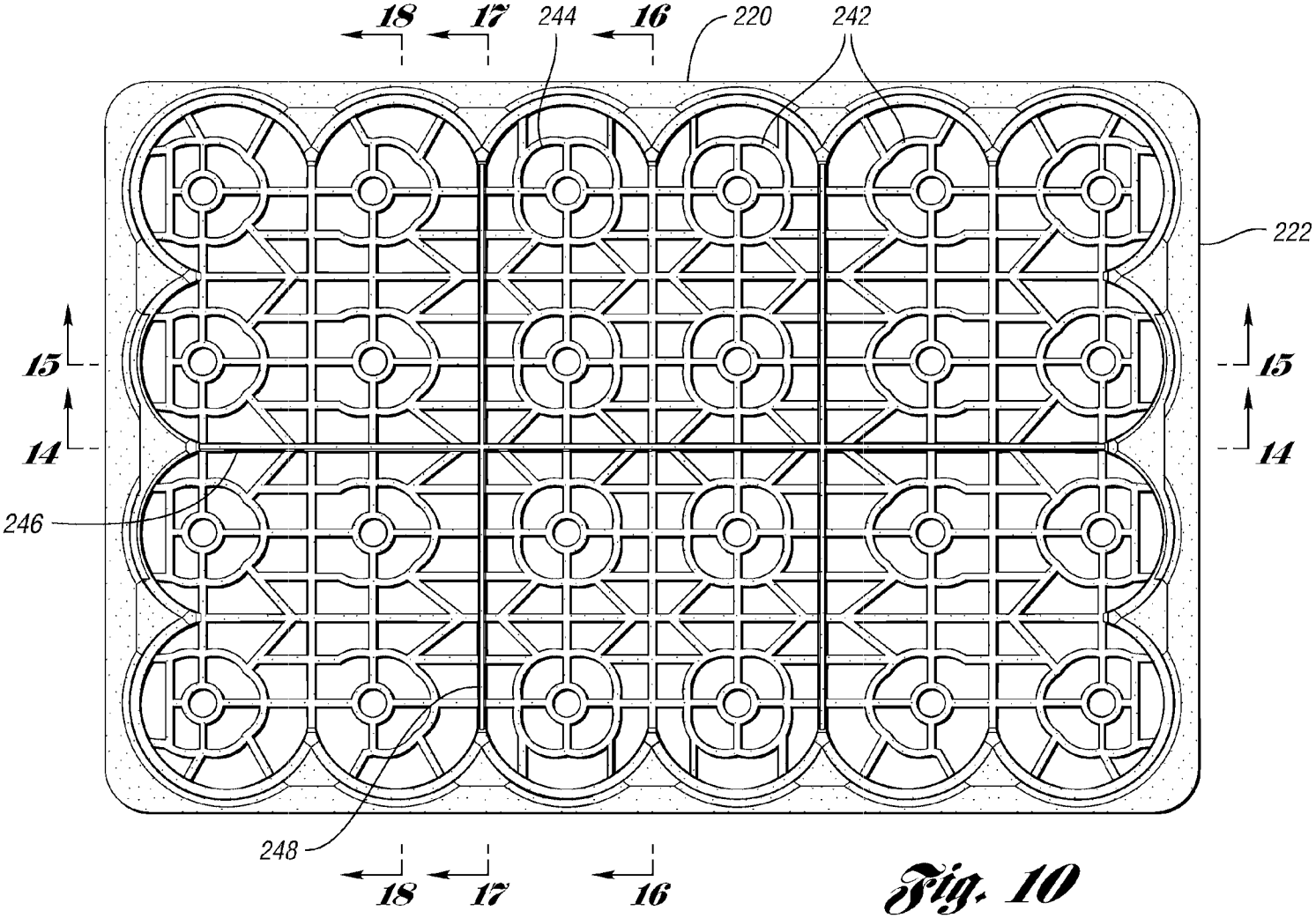
FIG. 10 is a top plan view of the crate of FIG. 9.
Figure 11:
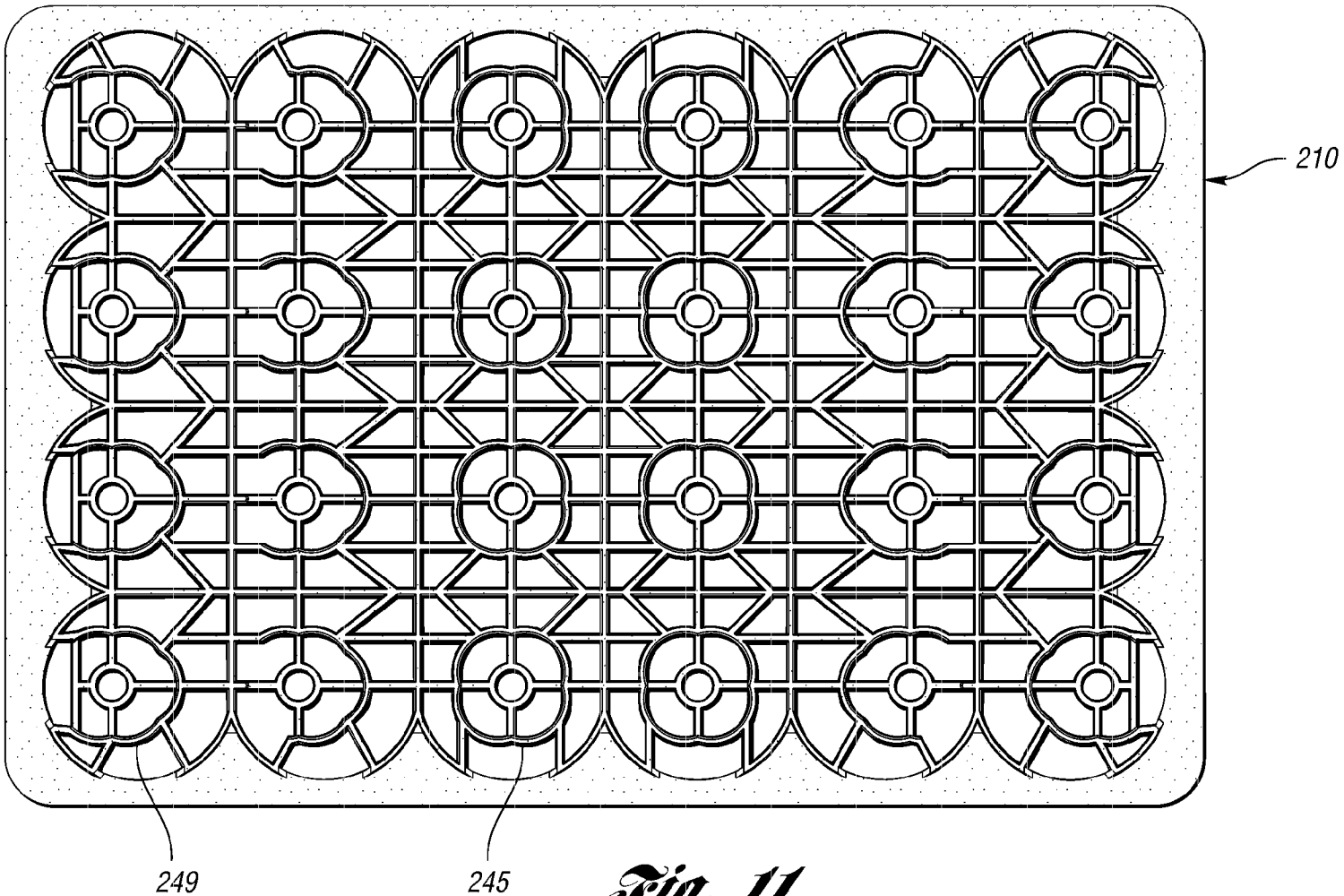
FIG. 11 is a bottom plan view of the crate of FIG. 9.
Figure 12:
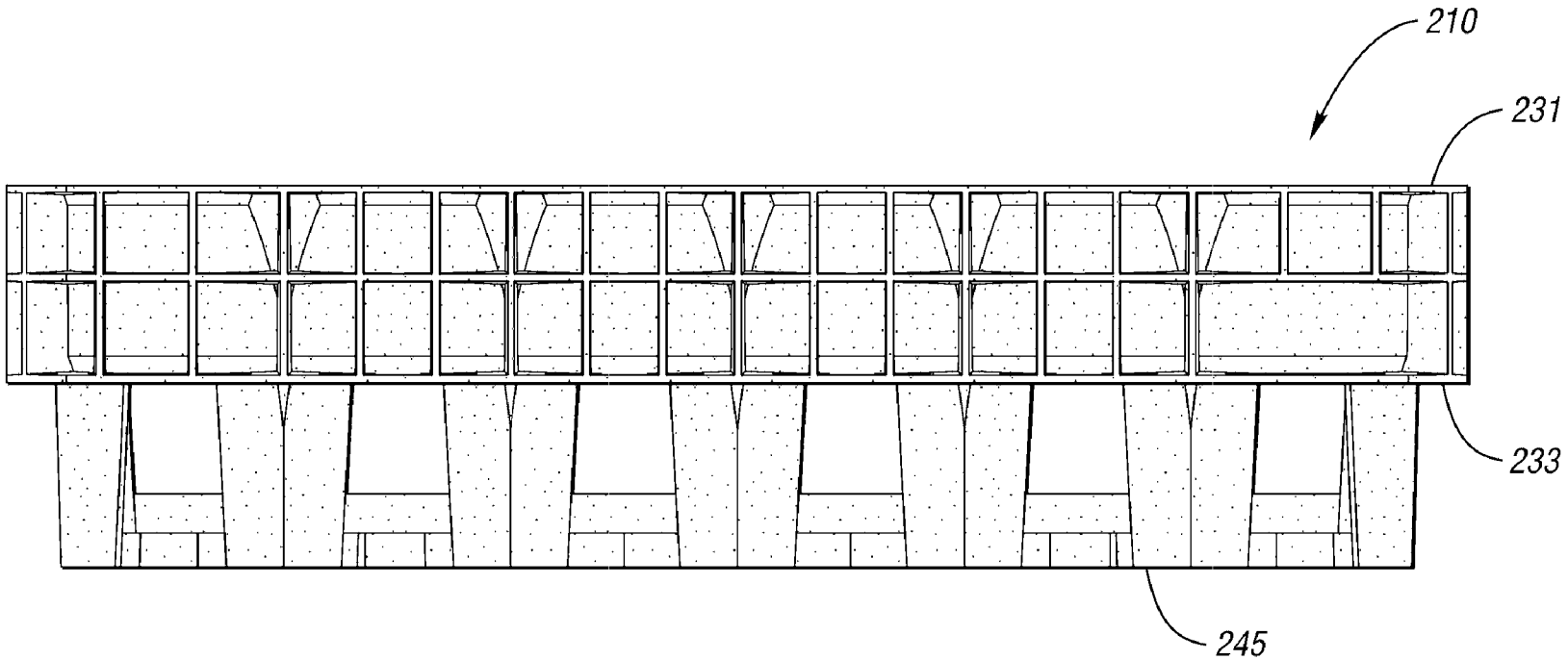
FIG. 12 is a front side elevational view of the crate of FIG. 9, the rear side elevational view being a mirror image thereof.
Figure 13:
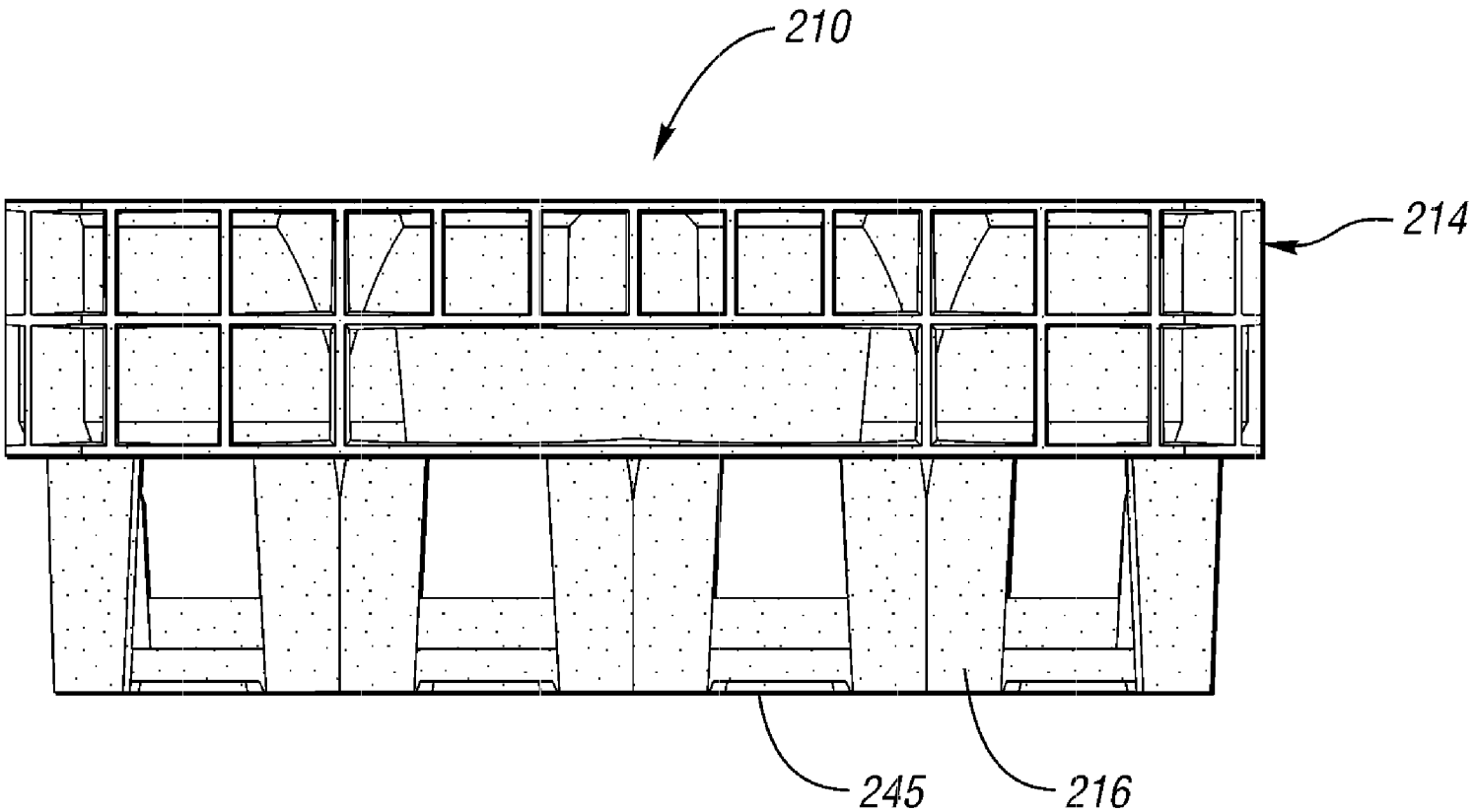
FIG. 13 is a left end elevational view of the crate of FIG. 1, the right end elevational view being a mirror image thereof.
Figure 14:
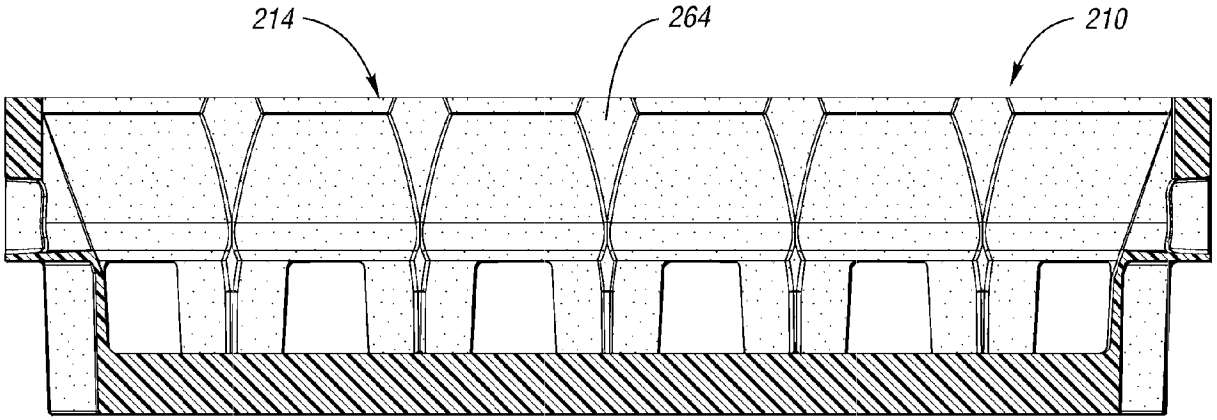
FIG. 14 is a sectional view taken along the lines 14-14 of FIG. 10.
Figure 15:
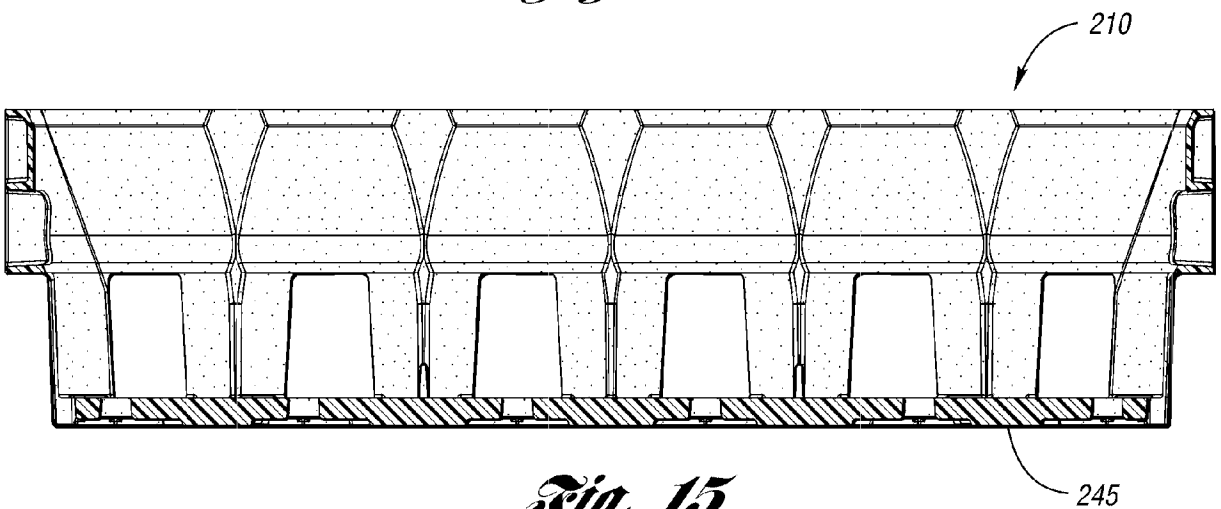
FIG. 15 is a sectional view taken along the lines 15-15 of FIG. 10.
Figure 16:
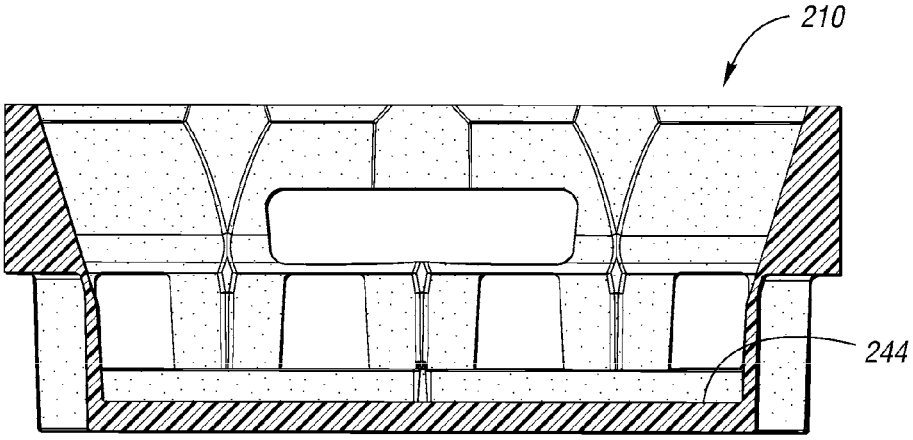
FIG. 16 is a sectional view taken along the lines 16-16 of FIG. 10.
Figure 17:
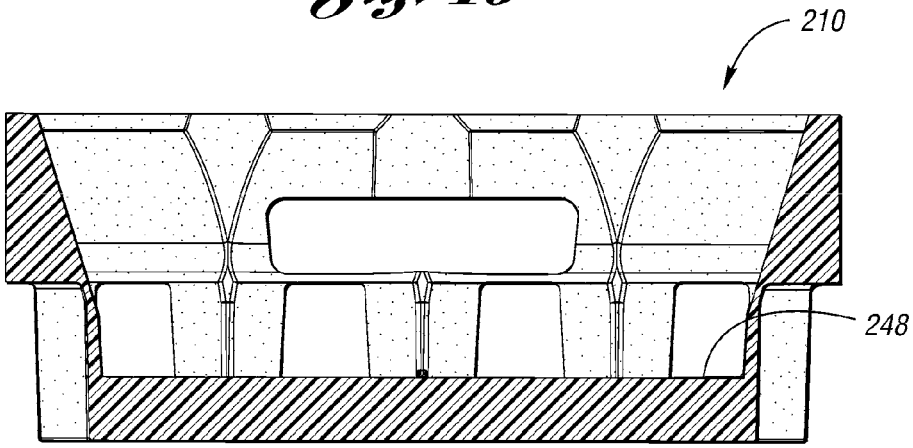
FIG. 17 is a sectional view taken along the lines 17-17 of FIG. 10.
Figure 18:
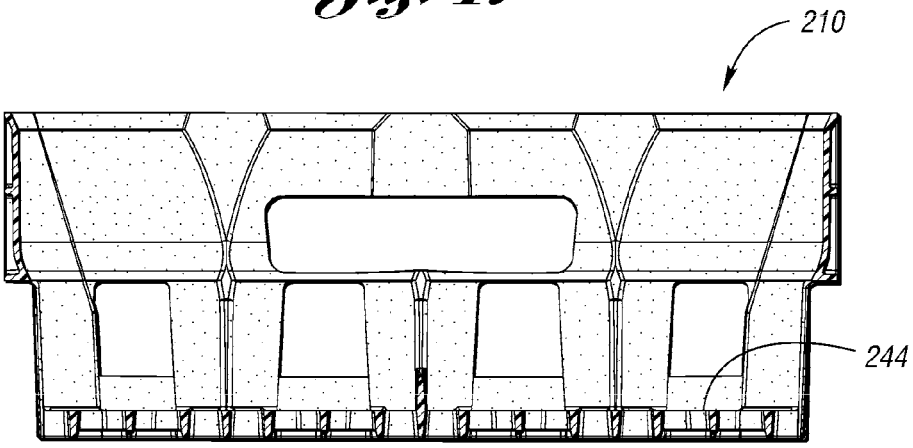
FIG. 18 is a sectional view taken along the lines 18-18 of FIG. 10.

Floor member 12 has an open lattice pattern that provides for a relatively lightweight crate and allows drainage. Floor member 12 is generally flat and planar and includes support areas 42 arranged in rows and columns to define one or more arrays. In the embodiment shown, a 4×6 array accommodates 24 20-oz bottles. Of course, this is by example and not limitation as the crate may be designed to support various quantities and sizes of bottles, without departing from the teachings herein. As shown in FIG. 9, upper surface 244 of floor 212 may also include a plurality of relatively low profile ribs 46,48 extending upwardly and across upper surface. Such ribs help provide stiffness to bottom 212.

Figure 5:
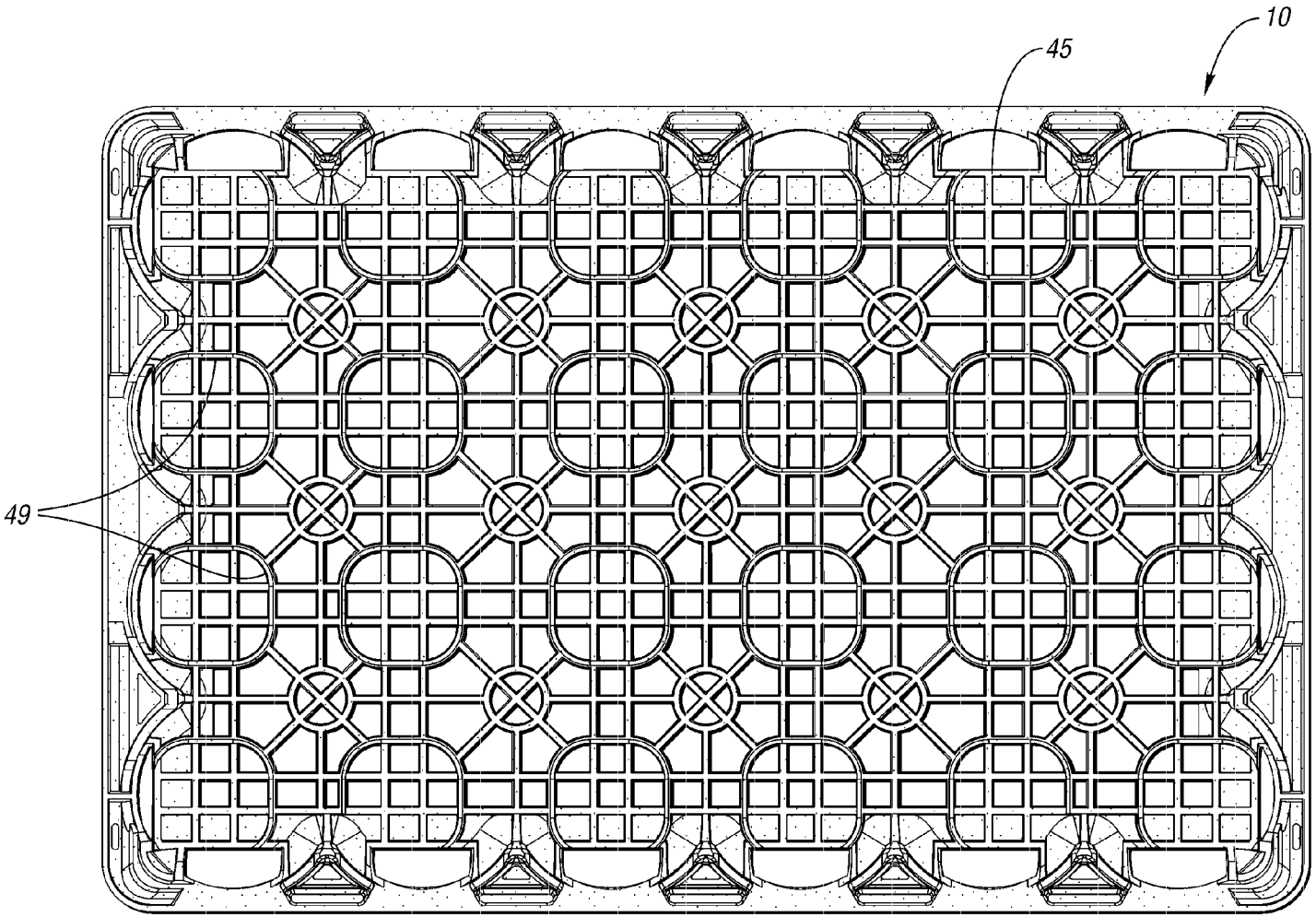
FIG. 5 is a bottom plan view of the crate of FIG. 1.
Figure 6:
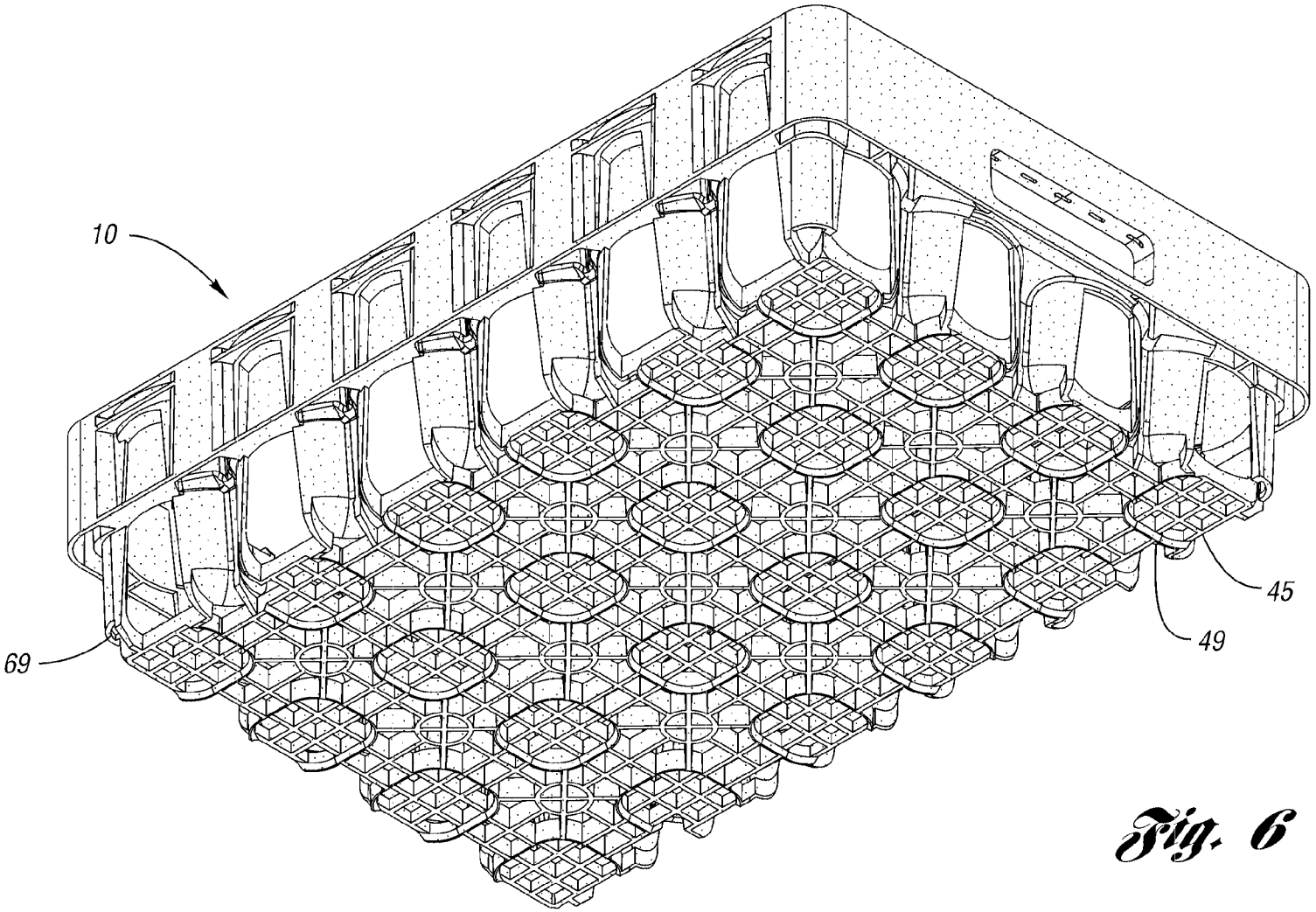
FIG. 6 is a bottom perspective view of the crate of FIG. 1.

As shown in FIGS. 5-6, floor bottom surface 45 has recesses below each receiving area 42 for receiving the tops of bottles 5 disposed in a crate stacked therebelow. The recesses are defined by downstanding rib members 49 that impede crate 10 from freely sliding along the top of bottles 5 beneath it, and makes it less likely that the bottles in a lower crate will tip.

Figure 19:
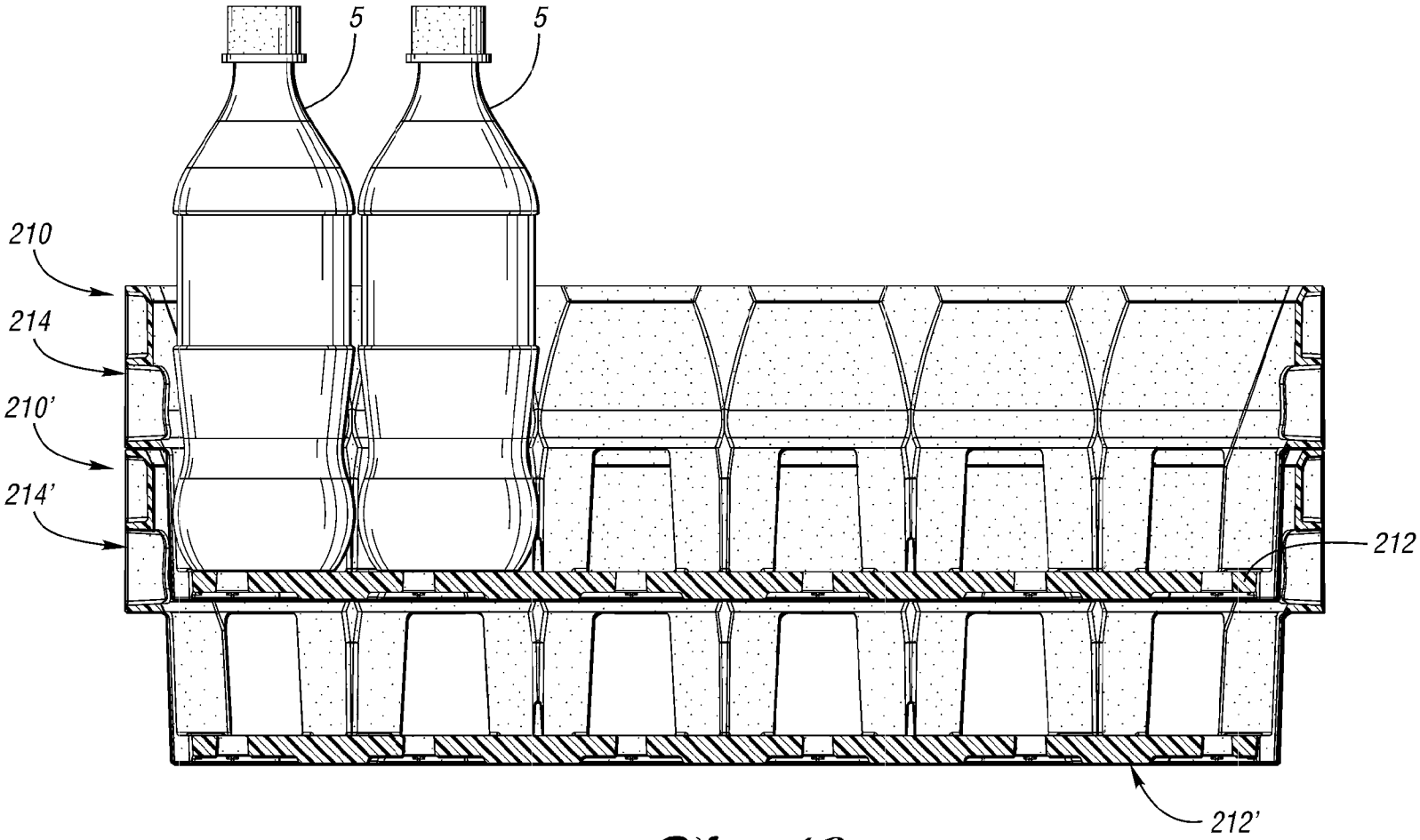
FIG. 19 is a cross-sectional view showing two crates of FIG. 9 nested and with a bottle disposed in the upper crate.
Figure 20:
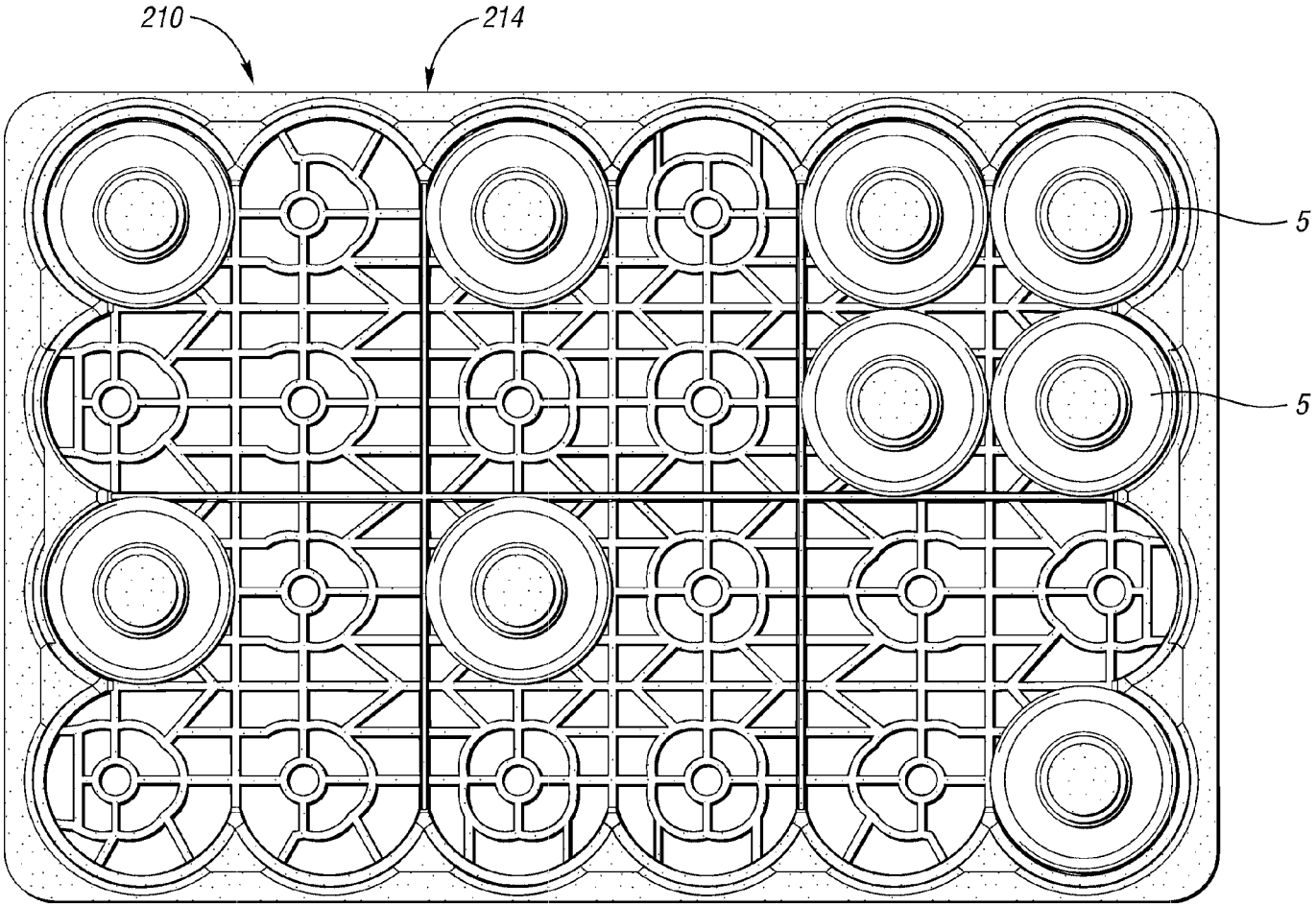
FIG. 20 is a top plan view of the crate of FIG. 9 with bottles disposed therein.

The various embodiments of the crate according to the present invention are nestable with similar crates, as illustrated in FIG. 19, which shows a cross-section of crates 210 and 210' nested together and holding a bottle 5. When in a nested arrangement, upper crate 210 fits into lower crate 210' so that the lower edge 235 of top band 214 rests upon the upper edge 23 1' of top band 214'.

With reference again to FIGS. 1-6, columns 16 along walls 20 and 22 of crate 10 that connect floor member 12 to band 14 are positioned between adjacent support areas 42 along the periphery of floor member 12. The wall structure has window openings 50 between columns 16, adjacent support members 42 and below band 14. Window openings 50 allow for visibility into crate 10, and also receive surface 21 of a lower crate when nested. The height of column 16 is sufficient to prevent containers 5 from tipping when transported, and allow the tops of containers 5 to extend above top band 14. Columns 16 have a generally single-walled construction, and have an interior surface 52 and a corresponding exterior surface 54. Exterior surface 54 of column 16 includes a centrally disposed recessed area 56 which, when nested with a similar crate, receives the corresponding inwardly disposed inner surface 64 of top band 14 disposed above and in vertical alignment with column 16 and have a common centerline therewith. Surfaces 64 provide nesting support and bottle stability.

Figure 8A:
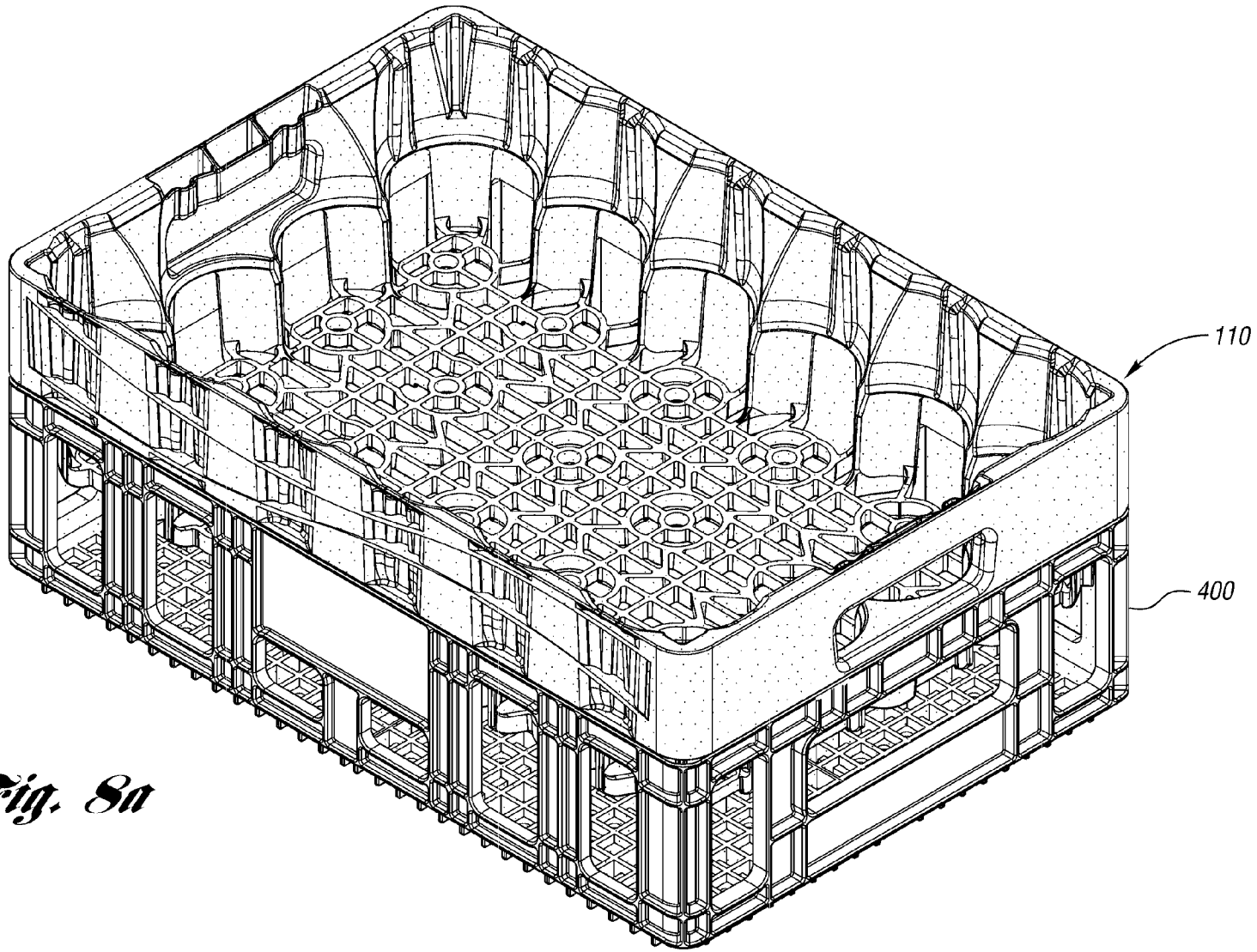
FIGS. 8*a* and 8*b* show, respectively, a perspective view and a cross-sectional view, of a second embodiment of a crate according to the present invention nested within a second prior art straight-walled half-depth crate.
Figure 8B:
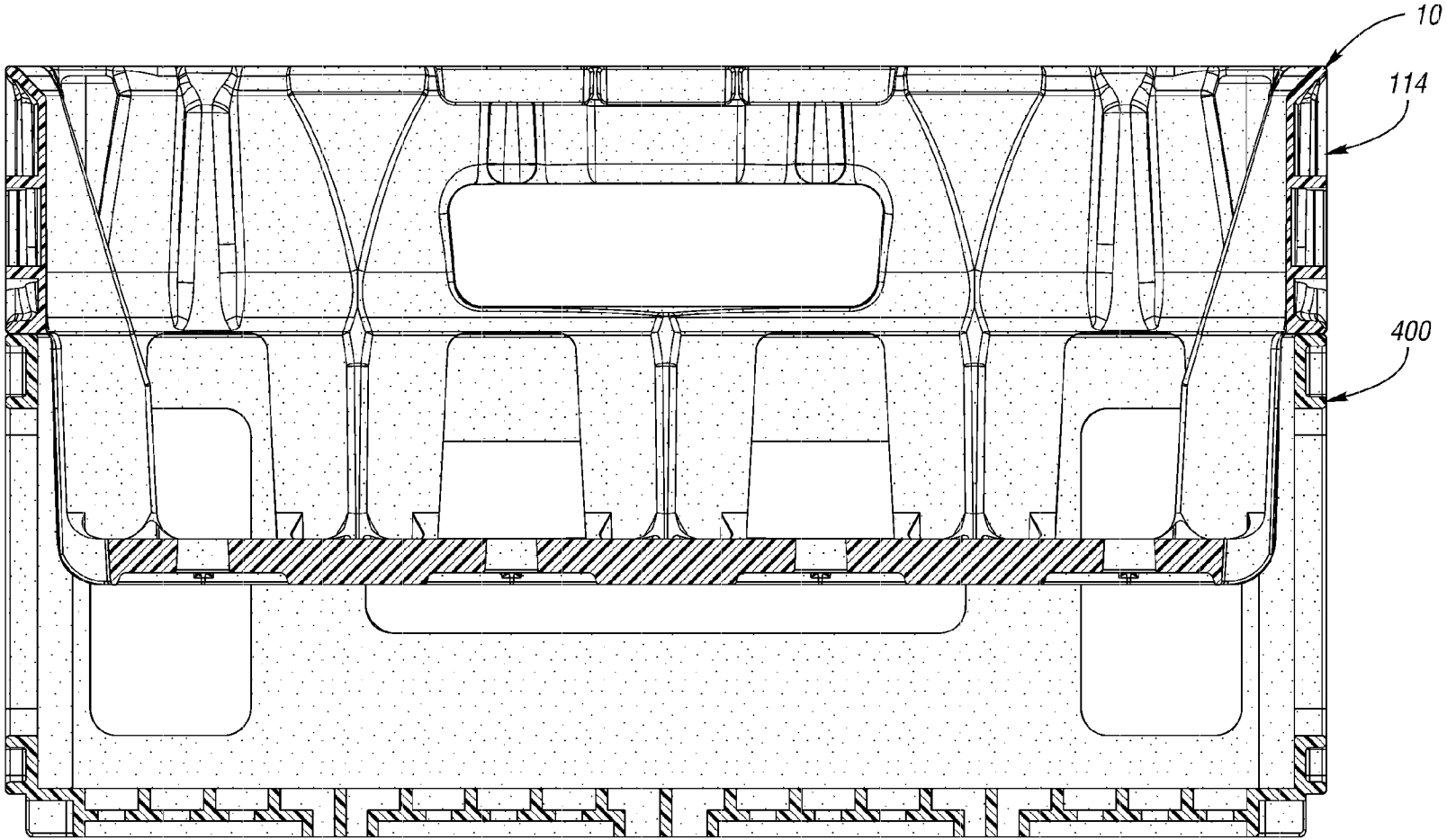

Interior surface 52 of column 16 is generally vertical and includes angled bottle surfaces 58 and 60 which meet at a centrally oriented, vertically disposed, inwardly directed lower surface or edge 62. In a preferred embodiment, bottle contact surface 21 is cylindrically planar with column surfaces 58,60. Upper inner surface 64 is disposed slightly outward from column inner surface 52, to provide a transition ledge 65 therebetween. Top band 14 is offset outwardly from columns 16 such that nesting is achieved, both with similar crates FIG. 19) and non-similar half-depth crates 400 with a similar footprint and which has a generally vertically wall structure, as previously described (FIGS. 8*a*-8*b*).

Columns 16 should also be strong enough to support the band 14 should containers 5 push against band 14. Columns 16 are generally defined by two arcuate faces 58,60 intersecting at a central edge 62, and may have a relatively larger area and cross-section at their bottoms, thus being more robust in their connection with floor member 12. Opposed surfaces 58, 60 of column 16 have a curvature generally mirroring that of adjacent bottles 5, such that the adjacent facing surfaces 58 of one column and 60 of an adjacent column cradle the bottles 5 therein.

With reference to FIGS. 1-2, corner columns 18 do not project inwardly into crate 10, but remain peripherally disposed, thereby providing a more secure corner pocket for a bottle stored therein. The degree of containment of corner bottle support area 42*a* results from the adjacent end and side columns 16*a*, 16*b*, as shown in FIG. 2.

Figure 7:
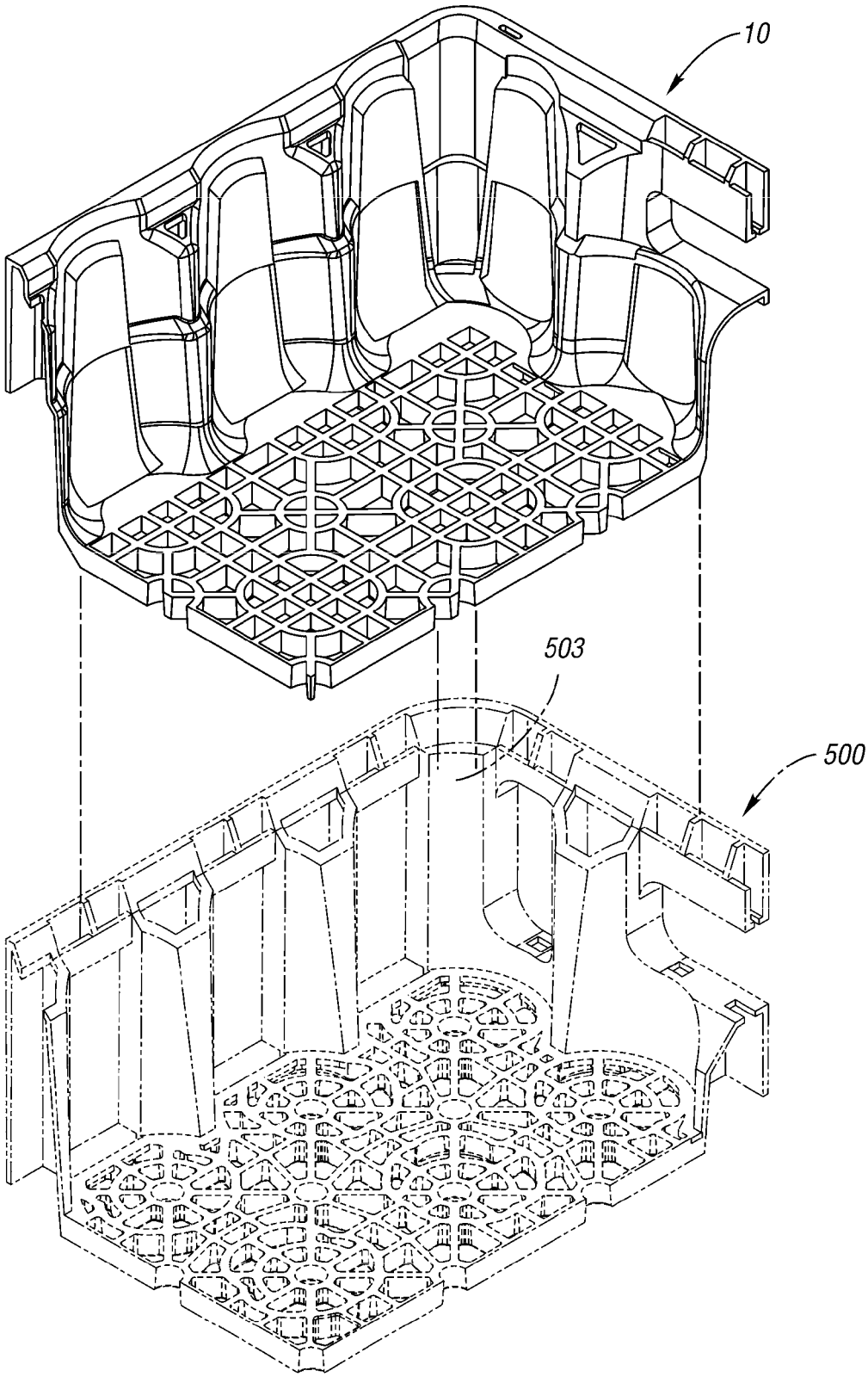
FIG. 7 is a perspective sectional view of the crate of FIG. 1 nested within a first prior art half-depth crate.

FIGS. 1, 6 and 7 illustrate another feature of crate 10 according to the present invention. As shown, the bottom surface of corner columns 18 and floor 12 define a recessed corner nesting area 69. Thus, as shown in FIG. 7, when crate 10 is nested within a prior art half-depth crate 500 that has a corner projection 503, nesting area 69 receives a portion of corner projection 503 to enhance the stackability and nestability of such containers.

As previously noted, typical half-depth crates may only stack (not nest) with similar half-depth crates due to their construction, while low-depth crates typically are nested within similar low-depth crates. Thus, crates according to this invention provide for dual application in that it may nest within similar container 210' (FIG. 19), and it also nests within a half-depth crate 400 of different construction (FIGS. 8*a*-8*b*), as illustrated by second embodiment of crate 110. Accordingly, crates according to the present invention provide efficient bottle containment having an optimally sized footprint similar to a non-nestable half-depth crate, while allowing for nestability both with similar crates and with non-nestable half-depth cases having a similar footprint. As shown in FIG. 8*b*, the outer surface of top band 114 is vertically disposed and coplanar with the outer surface of half-depth crate 400.

FIGS. 9-20 illustrate a third embodiment of a crate 210 according to the present invention. Features similar to those of the first embodiment have a corresponding reference number with a "2" prefix. Crate 210 includes a sidewall 220 and end wall 222 construction having a top band 214 with an interior surface 224 and an exterior surface 226. Exterior surface 226 of top band 214 is defined by a plurality of ribbed members projecting therefrom, which includes a plurality of horizontally disposed ribbed members which are oriented generally parallel to each other and designated as upper rib portion 230, intermediate rib portion 232, and lower rib portion 234. Upper and lower rib portions 230 and 234 define, respectively, the upper edge 23 and lower edge 233 of band member 214. Exterior surface 226 also includes a plurality of vertically disposed rib portions 236 extending around the perimeter of band member 214. Exterior surface 226 is vertically disposed and has little or no taper associated therewith.

Ribs 230-236 enhance the strength of crate 210 while using relatively less material and are particularly advantageous when used in association with automate lifting devices. When crates 210 are stacked upon a pallet in layers, these ribs define a generally planar surface by which the lifting device may grasp crates efficiently. Upon gripping, a compressive force is distributed among the crates and ribs 230-236 may serve to catch onto corresponding ribs of an adjacent crate to enhance the support of adjacent crates and impede the separation and translation down of crates in a layer. When adjacent crates 210 are in a layer of crates being lifted, should one crate begin to slip, it is contemplated that, for example, upper horizontal rib 230 of crate 210 may cooperate with ribs 232 and 236 of the adjacent crate to impede slippage.

Columns 216 that define side pockets 267 of crate 210 provide significant containment and wrap-around for bottles adjacent sidewalls 220 and end walls 222, as well as in the corners. This provides for more bottle surface contact and thus better bottle and load stability.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A nestable crate for holding bottles, said crate comprising:

a floor;

a wall structure connected to the floor and forming a containment area therewith, the wall structure having a peripherally extending upper band portion having an interior surface facing the containment area and an exterior surface, the wall structure including sidewalls and end walls, at least one of the sidewalls and end walls being formed with a handle portion, the wall structure including a lower wall portion below the upper band portion and offset inward from the upper band portion, wherein the crate is nestable with an identical crate such that the lower wall portion of the crate is received between opposing portions of the upper band portion of the identical crate;

wherein the handle portion includes a handle, an opening, and a lower portion extending from the floor to the opening, the lower portion includes two arcuate surfaces projecting into the containment area, the two arcuate surfaces extend to define part of a lower column, the lower column extends from the floor to a ledge, the ledge defines the upper surface of the lower column and the bottom of the opening; and wherein the ledge is generally planar, the opening does not extend below the plane of the ledge.

2. The crate of claim 1, wherein the opening is disposed below the handle.

3. The crate of claim 1, wherein the opening exists between two column members, each on a respective side of the lower column.

* * * * *